US007371104B2

(12) United States Patent
Wu

(10) Patent No.: US 7,371,104 B2
(45) Date of Patent: May 13, 2008

(54) CABLE ASSEMBLY WITH IMPROVED INSULATIVE MEMBER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/505,714

(22) Filed: Aug. 17, 2006

(65) Prior Publication Data

US 2007/0042646 A1 Feb. 22, 2007

(30) Foreign Application Priority Data

Aug. 17, 2005 (CN) ..... 2005 2 0074743

(51) Int. Cl.
*H01R 13/627* (2006.01)

(52) U.S. Cl. ..... 439/358

(58) Field of Classification Search ..... 439/606, 439/604, 358, 352, 353, 368, 363
See application file for complete search history.

(56) References Cited

U.S. PATENT DOCUMENTS

| | | | | |
|---|---|---|---|---|
| 5,733,145 | A * | 3/1998 | Wood | 439/604 |
| 6,338,652 | B1 * | 1/2002 | Ko | 439/579 |
| 6,402,552 | B1 * | 6/2002 | Wagner | 439/606 |
| 6,623,299 | B1 * | 9/2003 | Liu | 439/604 |
| 6,699,049 | B1 * | 3/2004 | Wu | 439/79 |
| 6,790,087 | B2 | 9/2004 | Ho | |

* cited by examiner

*Primary Examiner*—Alexander Gilman
(74) *Attorney, Agent, or Firm*—Wei Te Chung

(57) ABSTRACT

A cable assembly (1) includes an insulative housing (2), a number of terminals (3), a cable (5) and an insulative member (4). The housing defines a plurality of slits (25) therein. The terminals received in corresponding slits of the insulative housing, and each includes a tail portion (32). The cable electrically connects with the tail portion of the terminals. The insulative member assembled on a rear end of the insulative housing, and includes a vertical stopping plate (40) and a flat plate (41) extending from the stopping plate and perpendicular to the stopping plate. The stopping plate defines a plurality of passage hole (400). The tail portions of the terminals extend through corresponding passage holes.

10 Claims, 6 Drawing Sheets

CABLE ASSEMBLY WITH IMPROVED INSULATIVE MEMBER

BACKGROUND OF THE INVENTION

1. Field of the Invention

The present invention generally relates to a cable assembly, and more particularly to a cable assembly having an insulative member.

2. Description of the Prior Art

Serial Advanced Technology Attachment (SATA) Connector is applied in electrically connecting between a motherboard and an electronic member, such as a hard disk. Normally, a SATA connector comprises an electrical connector with a cable. The electrical connector comprises an insulative housing and a plurality of terminals. The cable comprises a plurality of conductors electrically connecting with corresponding terminals. The cable assembly further has an insulative member adapted for positioning the terminals and sealing the rear end of the insulative housing.

U.S. Pat. No. 6,623,299 discloses an SATA cable assembly, comprising an insulative housing, a plurality of terminals, a cable with a plurality of conductors and an insulative member. Each terminal comprises a retaining portion, a tail portion extending rearwardly from the retaining portion, and a contacting portion extending forwardly from the retaining portion. The insulative member comprises a plurality of positioning holes and a plurality of blocks at the upper and lower edges thereof. The insulative member is assembled to the rear of the insulative housing, with the blocks engaging with the inner face of the electrical connector. The tail portions pass through the positioning holes of the insulative member, and are soldered with the conductors of the cable. However, the tail portion is exposed beyond the insulative housing without any support. The conductor of the cable may have a movement during assembly. Accordingly, it is difficult to soldering the conductors to the corresponding terminals.

Hence, it is desirable to have an improved cable assembly to overcome the above-mentioned disadvantages of the prior art.

BRIEF SUMMARY OF THE INVENTION

Accordingly, the object of the present invention is to provide a cable assembly, which has an improved insulative member for ensuring the electrical connection between cable and connector.

In order to achieve the above-mentioned object, a cable assembly comprises an insulative housing, a plurality of terminals, a cable and an insulative member. The housing comprises a plurality of slits therein. The terminals received in corresponding slits of the insulative housing, and each comprises a tail portion. The cable electrically connects with the tail portion of the terminals. The insulative member assembled on a rear end of the insulative housing, and comprises a vertical stopping plate and a flat plate extending from the stopping plate and perpendicular to the stopping plate. The stopping plate defines a plurality of passage hole. The tail portions of the terminals extend through corresponding holes.

Other objects, advantages and novel features of the invention will become more apparent from the following detailed description of the present embodiment when taken in conjunction with the accompanying drawings.

DETAILED DESCRIPTION OF THE INVENTION

Figure 1:
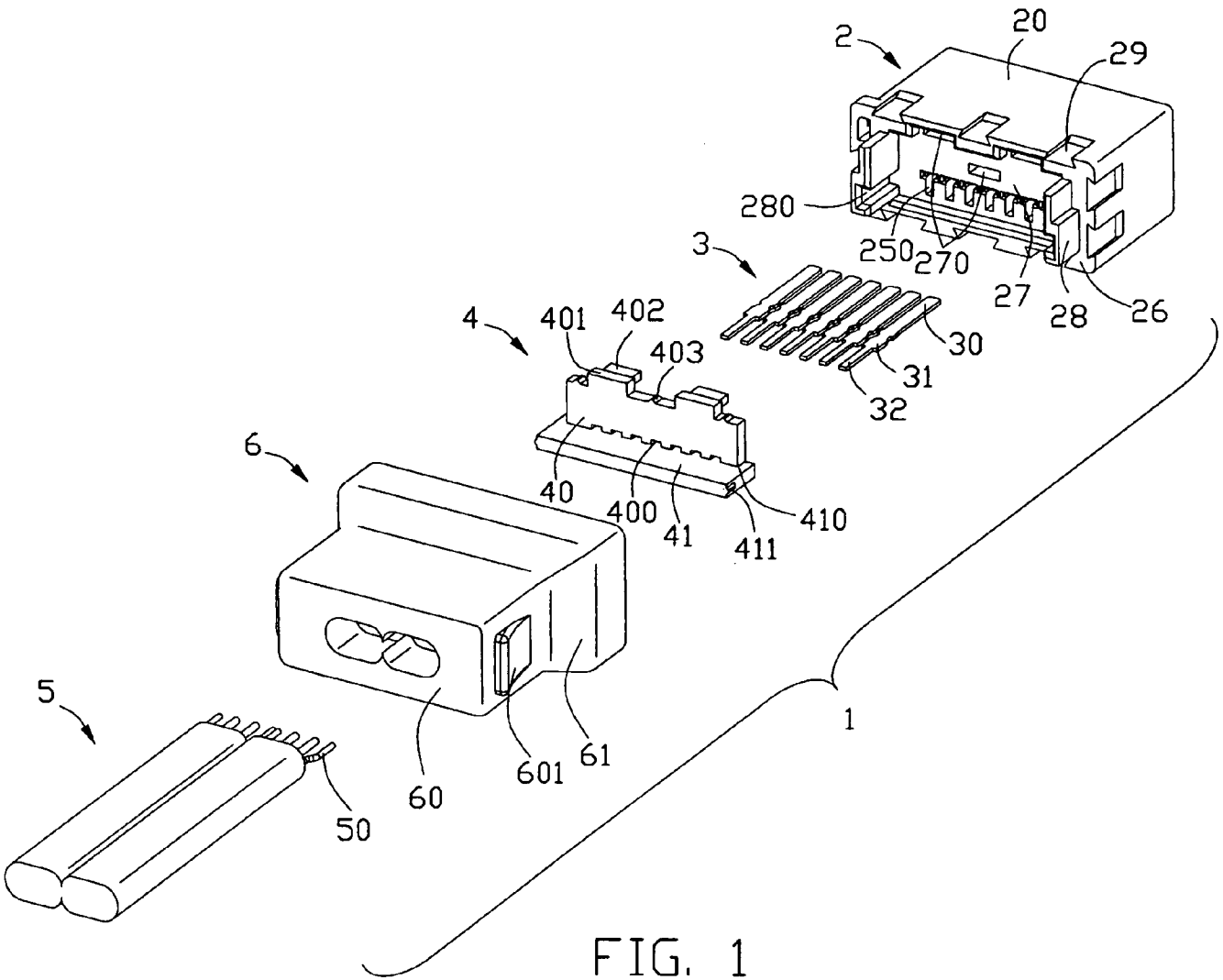
FIG. 1 is an exploded, perspective view of a cable assembly in accordance with the present invention.
Figure 2:
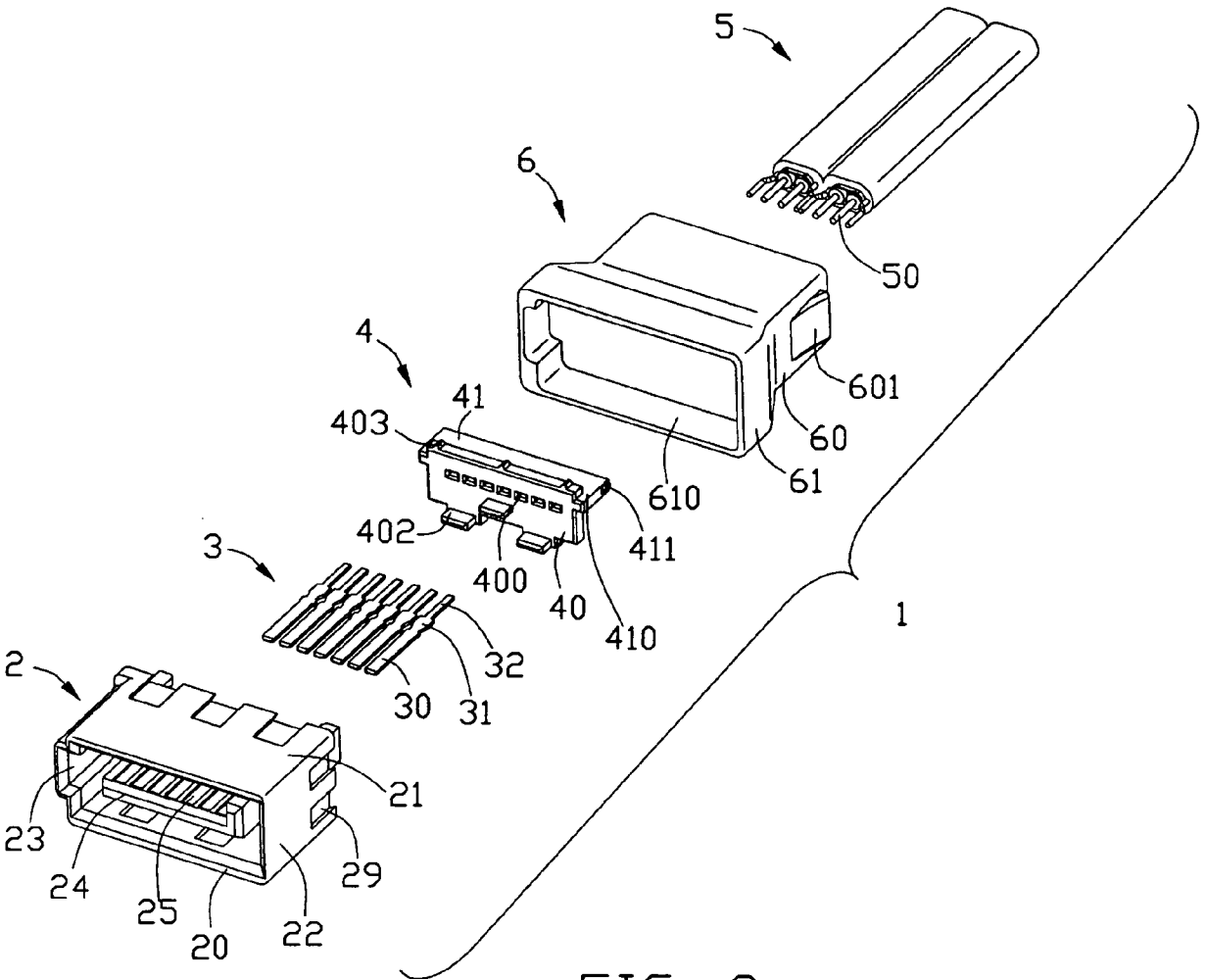
FIG. 2 is a view similar to FIG. 1, but taken from a different aspect.
Figure 3:
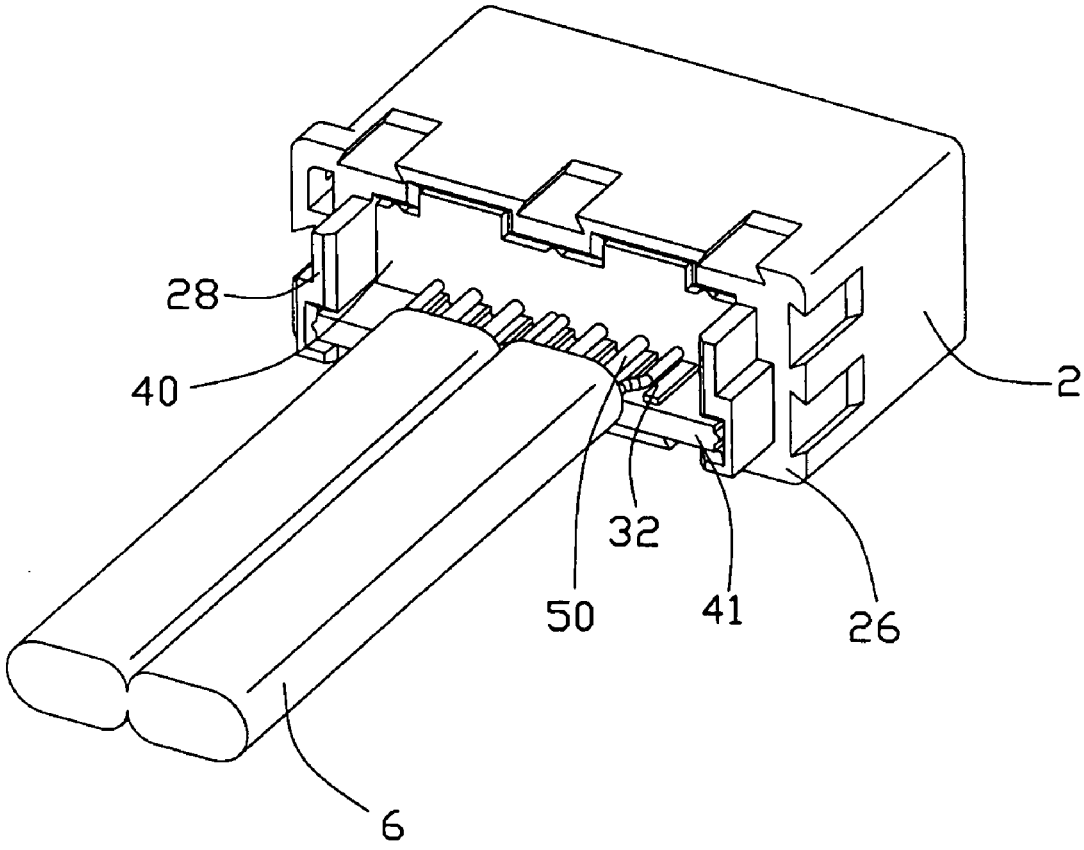
FIG. 3 is a partially assembly view of FIG. 1.

Reference will now be made to the drawing figures to describe the present invention in detail.

Figure 4:
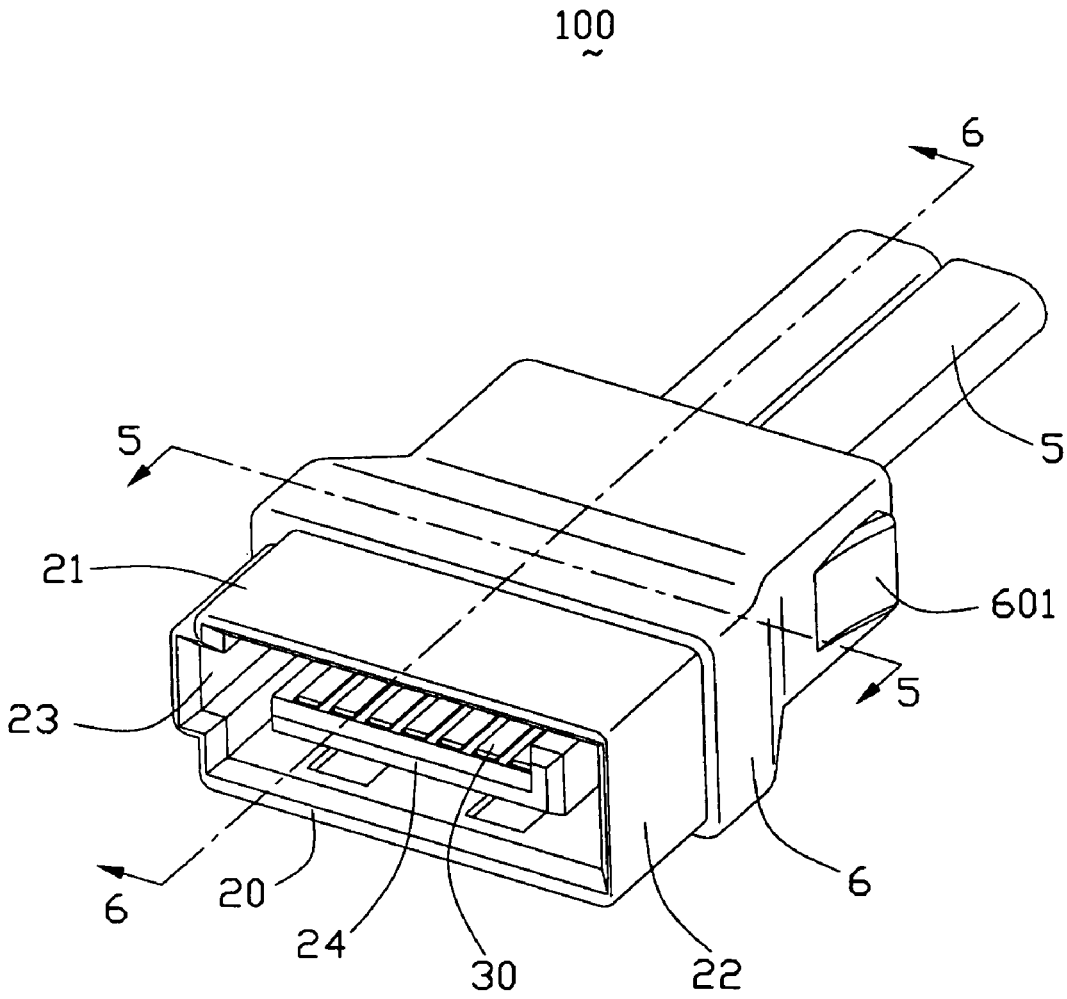
FIG. 4 is a view similar to FIG. 3, but taken from a different aspect.

Referring to FIGS. 1 and 4, a cable assembly 1 in accordance with the present invention comprises an insulative housing 2, a plurality of terminals 3 received in the insulative housing 2, an insulative member 4 firmly assembled to the insulative housing 2, a cable 5 electrically connecting with the terminals 3 and an insulative cover 6.

The insulative housing 2 comprises a top wall 20, a bottom wall 21 opposite to the top wall 20, a pair of lateral walls 22, and a rear wall 26. Those walls together define a receiving space 23. The rear wall 26 comprises an L-shape tongue 24 extending from the rear wall 26 into the receiving space 23, a plurality of cutouts 250 and a depressing portion 27. The tongue 24 defines a plurality of slits 25 communicating with corresponding cutouts 250. A pair of positioning portions 28 extend rewarwardly from the rear wall 26. The pair of positioning portions 28 each defines a U-shape positioning passage 280 opening toward each other communicating with the depressing portion 27. The distance between the positioning portions 28 is equal to the length of the depressing portion 27. Three retaining slots 270 are defined on the rear wall 26 above the cutouts 250 with different height relative to the bottom wall 21. A plurality of retaining slits 29 are spaced arranged in the top wall 20, the bottom wall 21 and the lateral walls 22 adjacent to the rear wall 26.

The terminals 3 are inserted into the housing 2 along a back-to-front direction. Each terminal 3 comprises a flat contacting portion 30 extending into the receiving space 23 and received in the slit 25 of the tongue 24, an engaging portion 31 extending rearwardly from the contacting portion 30 and engagingly received in slit 25, and a tail portion 32 extending from the engaging portion 31 and exposed out of the insulative housing 2. The contacting portion 30 is adapted for electrically connecting with corresponding terminals of a complementary connector (not shown). The engaging portion 31 forms a plurality of bars (not labeled) at the opposite edges thereof for engaging with the inner face of the slit 25 the insulative housing 2.

Figure 5:
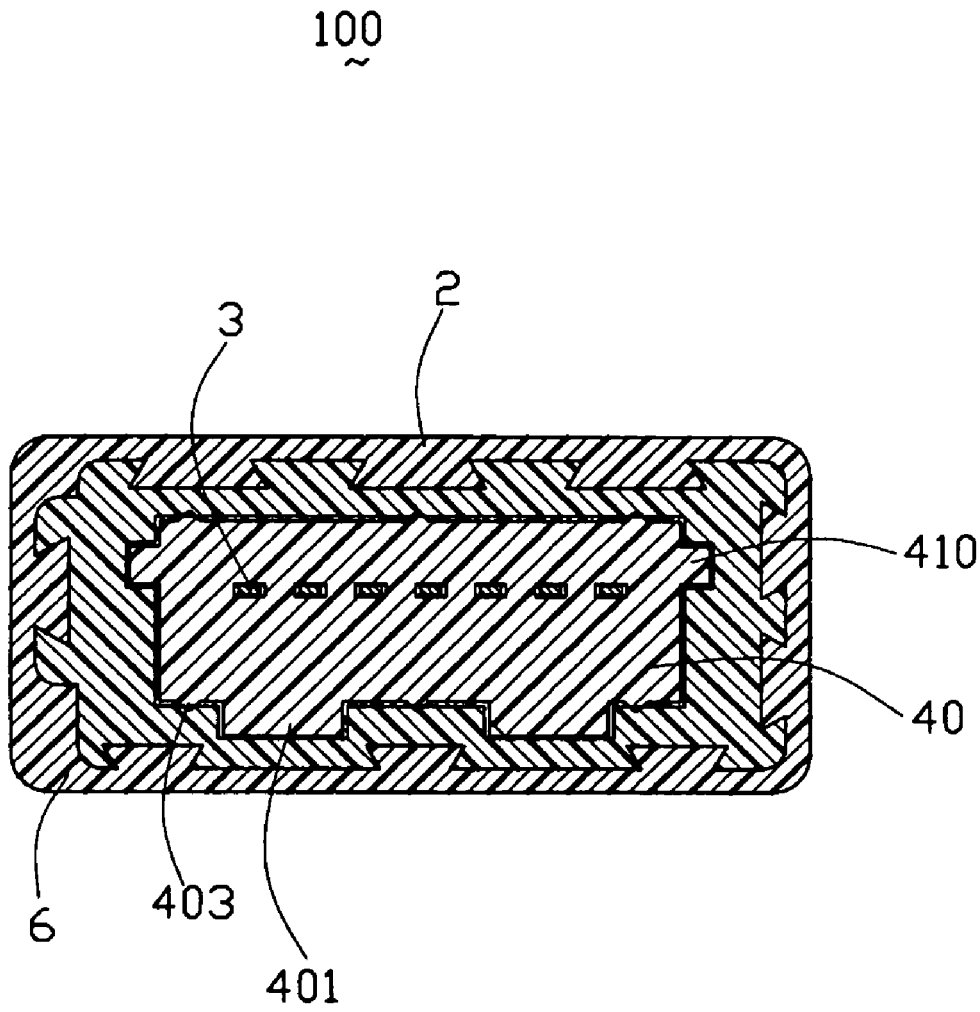
FIG. 5 is cross-section view taken along line 5-5 of the cable assembly shown in FIG. 4.
Figure 6:
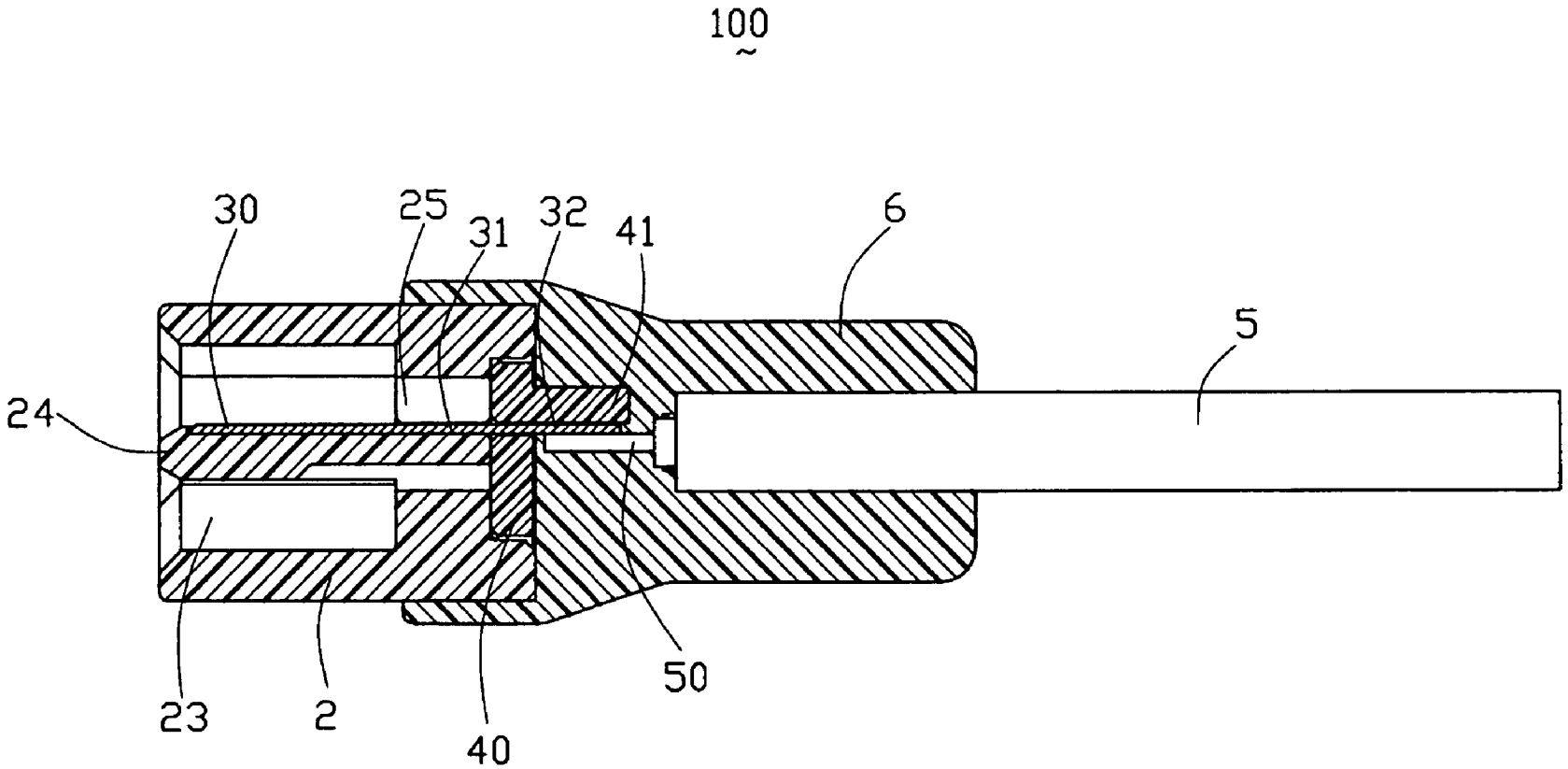
FIG. 6 is a cross-section view taken along line 6-6 of the cable assembly shown in FIG. 4.

Turning to FIG. 5 and FIG. 6, the insulative member 4 comprises a vertically extending stopping plate 40 and a flat plate 41 perpendicularly extending from the stopping plate 40. The stopping plate 40 comprises a plurality of passage holes 400 corresponding to the slits 25, three protruding wedges 403 on top and bottom edges thereof, and two bulges 401 extending upwardly therefrom between every two protruding portions 403. Three positioning blocks 402 corresponding to the retaining slots 270 of the insulative housing 2, respectively, extend forwardly from the front surface of the stopping plate 40 and the bulges 401. The flat plate 41 has a bigger width than that of the stopping plate 40, and the portions beyond the stopping plate 40 are formed with a pair of opposite end portions 410. Each end portion 410 defines a retaining strip 411 thereon.

Each cable 5 is a standard SATA cable in the present invertion and comprises two differential pairs 50 and two pairs of grounding conductors and an insulative layer (not labeled) enclosing the conductors 50.

Referring FIGS. 1-3 and FIG. 5, the insulative member 4 is assembled on the insulative housing 2 after the terminals 3 are inserted into the insulative housing 2. The end portions 410 of the insulative member 4 slide along the positioning passages 280 until the retaining strips 411 completely received in corresponding positioning passages 280 and resist with the inner faces of corresponding positioning passages 280. The stopping plate 40 of the insulative member 4 is received in the depressing portion 27 of the insulative housing 2 with the positioning blocks 402 of the stopping plate 40, respectively, received in corresponding retaining slots 270. Thereby, the insulative member 4 is assembled on the insulative housing 2 firmly. The tail portions 32 of the terminals 3 is inserted through the passage holes 400 of the insulative member 4 and arranged on the flat plate 41. During soldering, the tail portion 32 and the conductor 50 of the cable 5 are supported by the flat plate 41 so as to ensure the electrically connecting therebetween.

The insulative cover 6 is over-molded with rear portion the insulative housing 2 and the front end of the cable 5. The stopping plate 41 of the insulative member 4 prevents the thawing plastic flowing into the slits 25 along the cutouts 250. The insulative cover 6 forms a pair of handles 601.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

an insulative housing defining therein a mating port and a plurality of passageways communicating with said mating port;

a plurality of contacts disposed in the corresponding passageways, respectively, with corresponding mating portions exposed to said mating port and corresponding tails exposed outside a rear face of the housing;

an essentially L-shape insulator including a vertical plate and a lower horizontal plate with a plurality of through holes formed in a junction area between the vertical plate and the horizontal plate so as to allow said tails extending therethrough to be seated upon an upper face of the horizontal plate; wherein a plurality of projections unitarily extending from a front face of the vertical plate and extending into corresponding holes which is forwardly recessed from the rear face of the housing.

2. The assembly as claimed in claim 1, wherein the insulative housing has an L-shape tongue, said passageways are defined on the tongue.

3. The assembly as claimed in claim 1, further comprising a cable electrically connecting with the tails of the contacts, and wherein the cable comprises a two differential pair and two pairs of grounding conductors.

4. The assembly as claimed in claim 1, wherein the interface of the assembly is a standard SATA interface.

5. The assembly as claimed in claim 1, wherein the housing defines a horizontal rail on the rear face to guidably receive the horizontal plate.

6. The assembly as claimed in claim 5, wherein edges of the both the horizontal plate and the vertical plates form bumps thereon for retention with the housing.

7. The assembly as claimed in claim 1, wherein the insulative housing comprises a top wall, a bottom wall opposite to the top wall, a pair of lateral walls, and a rear wall, those walls together define a receiving space.

8. The assembly as claimed in claim 7, wherein the rear wall defines a depressing portion receiving the insulator.

9. The assembly as claimed in claim 1, further comprising an insulative cover over-molded with the insulative housing and the insulator.

10. The assembly as claimed in claim 9, wherein the insulative cover comprises a pair of handles at the opposite sides thereon.

* * * * *